United States Patent [19]

Manella

[11] 4,395,257

[45] Jul. 26, 1983

[54] SEPARATING VESSEL AND A SEPARATING CENTRIFUGE FOR USE IN THE CENTRIFUGAL SEPARATION OF A LIQUID

[75] Inventor: Paul Manella, Dübendorf, Switzerland

[73] Assignee: Doltron AG, Uster, Switzerland

[21] Appl. No.: 267,715

[22] Filed: May 28, 1981

[30] Foreign Application Priority Data

Jun. 10, 1980 [CH] Switzerland ..... 4450/80

[51] Int. Cl.[3] ..... B04B 5/00; B04B 9/00

[52] U.S. Cl. ..... 494/47; 150/0.5; 150/1, 0.5; 494/21; 424/84

[58] Field of Search ..... 233/26, 25, 21, 22, 233/19 R, 19 A, 1 R, 3, 28, 27; 128/214 R, 214 B, 214 E; 150/1, 0.5; 366/287, 288; 494/47, 21, 84

[56] References Cited

U.S. PATENT DOCUMENTS

| | | | |
|---|---|---|---|
| 3,742,994 | 7/1973 | Pensak | 150/0.5 |
| 4,090,541 | 5/1978 | Cammarata | 150/0.5 |
| 4,113,173 | 9/1978 | Lolachi | 233/25 |
| 4,140,162 | 2/1979 | Gajewski | 150/1 |
| 4,283,004 | 8/1981 | Lamadrid | 233/25 |
| 4,296,882 | 10/1981 | Kobayashi | 233/25 |

FOREIGN PATENT DOCUMENTS

| | | | |
|---|---|---|---|
| 873492 | 5/1979 | Belgium . | |
| 2354368 | 5/1974 | Fed. Rep. of Germany | 233/25 |

*Primary Examiner*—Robert W. Jenkins

*Attorney, Agent, or Firm*—Charles E. Brown

[57] ABSTRACT

A separating vessel, intended to be inserted into a separating centrifuge, consists in a hollow cylinder manufactured from a soft PVC, whereby connection conduits for the feed of the liquid to be separated and for the discharge of the separated fractions open into said hollow cylinder. The separating centrifuge comprises a centrifuge rotor which is rotatable around a first axis of rotation and is driven by a driving motor via a driving arrangement. There is provided further a support mounted to the centrifuge rotor to rotate around a second axis of rotation. The two axis of rotation extend perpendicularly to each other. There is provided furthermore a connecting part receiving the connection conduits, which connecting part is mounted at one end against rotation and lies on the first axis of rotation. The supporting device rotates in order to equalize a twisting of the connecting conduits. The separating vessel is an integral part and accordingly it can be easily exchanged at a plasmapheresis in vivo whereby a remixing and contamination is not possible.

10 Claims, 6 Drawing Figures

SEPARATING VESSEL AND A SEPARATING CENTRIFUGE FOR USE IN THE CENTRIFUGAL SEPARATION OF A LIQUID

BACKGROUND OF THE INVENTION

Field of the Invention

The present invention relates to a separating vessel for use in a centrifugal separation of a liquid into fractions of different densities. It also relates to a separating centrifuge for the separation of a liquid into fractions of different densities, which centrifuge is provided with a separating vessel and a control means for controlling the separating process.

A centrifuge for handling of a liquid such as blood is disclosed in the CH-PS No. 547 662. This centrifuge comprises a hose, arranged in a rotor, in which hose the handling of the liquid, i.e. the blood, takes place, whereby means are provided for introducing the liquid to be handled and for discharging of the handled liquid, i.e. of the separated fractions. This hose extends within the rotor and is rotatably supported in the rotor for rotation about its own axis. Furthermore, there are provided braking devices acting such onto the hose that it rotates relative to the rotor about its own axis during the rotation of the rotor.

The drawback of this known centrifuge is that it cannot be used for a continuous plasmapheresis in vivo.

The DE-OS No. 23 54 368 discloses a centrifuge having a separating vessel including feed conduits and discharge conduits, which separating vessel is mounted within a rotor such that it rotates about a first axis. The separating vessel is rotatable furthermore about a second axis and in operation is surrounded by a sealing liquid, such that the centrifuge can operate without any mechanical rotational seals.

The disadvantage of this centrifuge is however that when feeding a liquid to be separated this liquid will be diluted and furthermore the exchanging of the separating vessel is a relatively complicated procedure.

A further separating centrifuge is disclosed in the DE-PS No. 28 48 953 which separating centrifuge comprises three rotors which rotate independently from each other, whereby the inner rotor is arranged for receiving a separating vessel.

This separating centrifuge features however the drawback, that due to the rather great number of rotating parts an alignment of the complete system is relatively difficult, that the mounting and dismounting of the utensils is extremely complicated and in that the inner rotor operates at an extremely high rotational speed such that large forces act onto the utensil in the outer rotor.

SUMMARY OF THE INVENTION

Hence, it is the general object of the present invention to provide an improved construction of a separating vessel for use in a centrifugal separation, and to provide a separating centrifuge for separation of a liquid into fractions of different densities, which is extremely simple in construction and design, reliable in operation, economic to manufacture and dependable in use.

Now, in order to implement these and still further objects of the invention, which will become more readily apparent as the description proceeds, the separating vessel of this development is manifested by the features that it comprises a double-walled hollow cylindrical body defining an annular chamber and comprises further at least three connection conduits opening into said annular chamber, which annular chamber is partitioned in longitudinal direction thereof such that one of said connection conduits opens into one longitudinal end section and the other of said connection conduits opens into the other, opposite end section of said annular chamber.

A further object of the invention is to provide a separating centrifuge which has no mechanical couplings and is provided with a slipless and rotationally stable drive.

This object of the invention is achieved by a separating centrifuge comprising a centrifuge rotor rotatable about a first vertically extending axis of rotation, a supporting means for supporting said separating vessel, which separating vessel is mounted in said separating centrifuge arranged to rotate about a second horizontally extending axis of rotation, and comprising further a connection member intended to receive the connecting conduits of said separating vessel, which vessel is held at one end against rotation and lies on said first axis of rotation, and is mounted at the other end on said supporting means.

BRIEF DESCRIPTION OF THE DRAWINGS

The invention will be better understood and objects other than those set forth above will become apparent when consideration is given to the following detailed description thereof. Such description makes reference to the annexed drawings, wherein

In FIGS. 1 to 3 there are shown various preferred embodiments of the separating vessel 1. The separating vessel 1 is constructed in the form of a double-walled hollow cylinder consisting in a hose-section made of a medical soft-PVC (polyvinylchloride). The hose is welded together at one end thereof such that there is formed an annular chamber 2, partitioned in longitudinal direction thereof. There are provided three connecting conduits serving for a feeding of the liquid to be separated, and for the discharge of the separated fractions, respectively. These three conduits are welded into the inner wall of the hollow cylinder and communicate with chamber 2. Conduit 3 is the feed line and opens into the central area of the separating vessel and is arranged at one end section of chamber 2, and the conduits 4, 5 acting as discharge lines are arranged on one line and open into an edge section of the separating vessel and are arranged at the other end of chamber 2 such as shown in FIGS. 1 and 2.

Figure 2:
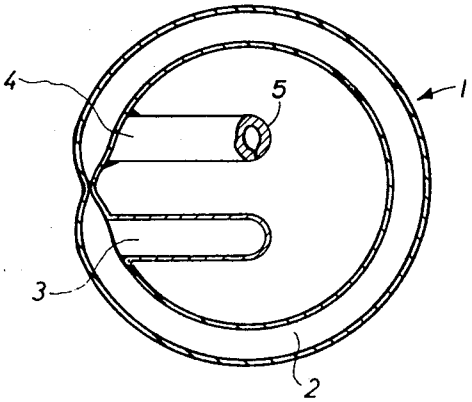
FIG. 2 is a sectional view along the line II—II of FIG. 1.
Figure 1:
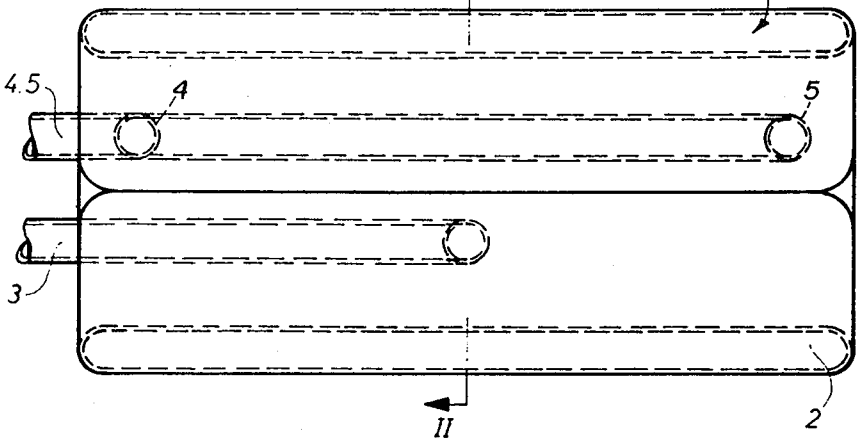
FIG. 1 is a plan view of an embodiment of a separating vessel constructed according to the present invention.
Figure 3:
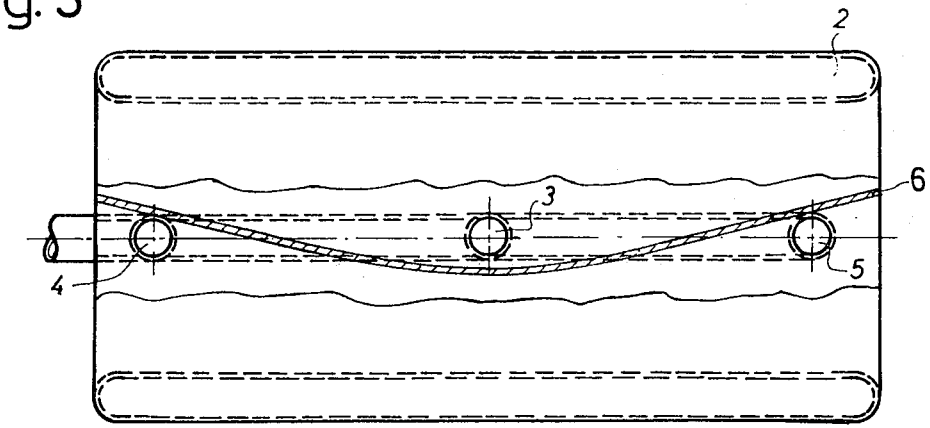
FIG. 3 is a plan view of a further embodiment of the separating vessel according to the invention whereby parts are shown partly broken away and partly in section.

The separating vessel shown in FIG. 3 is an integral one-piece construction, i.e. the hollow cylinder and the connecting conduits 3,4,5 are extruded in one process step. Accordingly, these connection conduits 3,4,5 are arranged such that they lie on one line, whereby the feed conduit 3 and the discharge conduits 4 and 5 are separated from each other by means of a partition web 6, separating the chamber 2 in longitudinal direction such that the feed conduit is arranged at one end of chamber 2 and the discharge conduits 4 and 5 are arranged at the other end of chamber 2.

Figure 4:
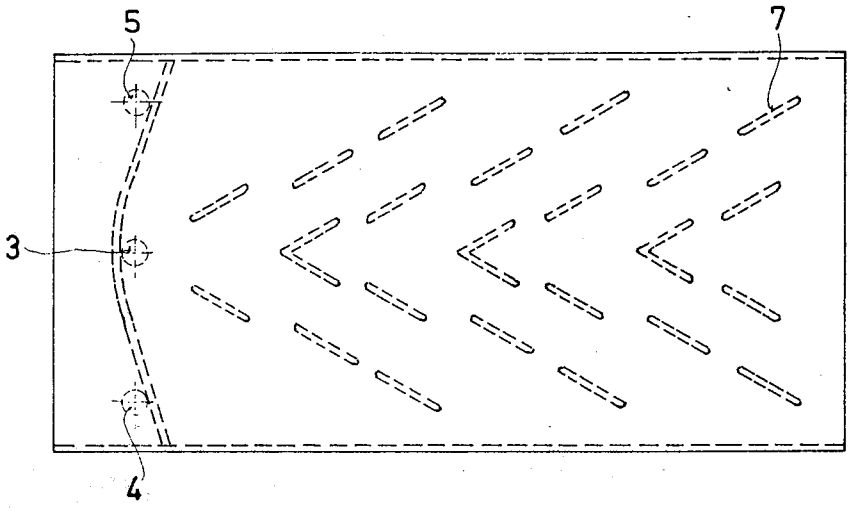
FIG. 4 is a development of a further embodiment of the separating vessel according to the invention.

FIG. 4 discloses that within the annular chamber 2 there are provided lamellas 7 in accordance with a further preferred embodiment of the invention, which lamellas 7 improve the separation of the liquid.

A device for a centrifugal separation of a liquid contains customarily a separating centrifuge as well as a control device, which are not particularly described herein, because their arrangement and design is commonly known in the art.

Figure 5:
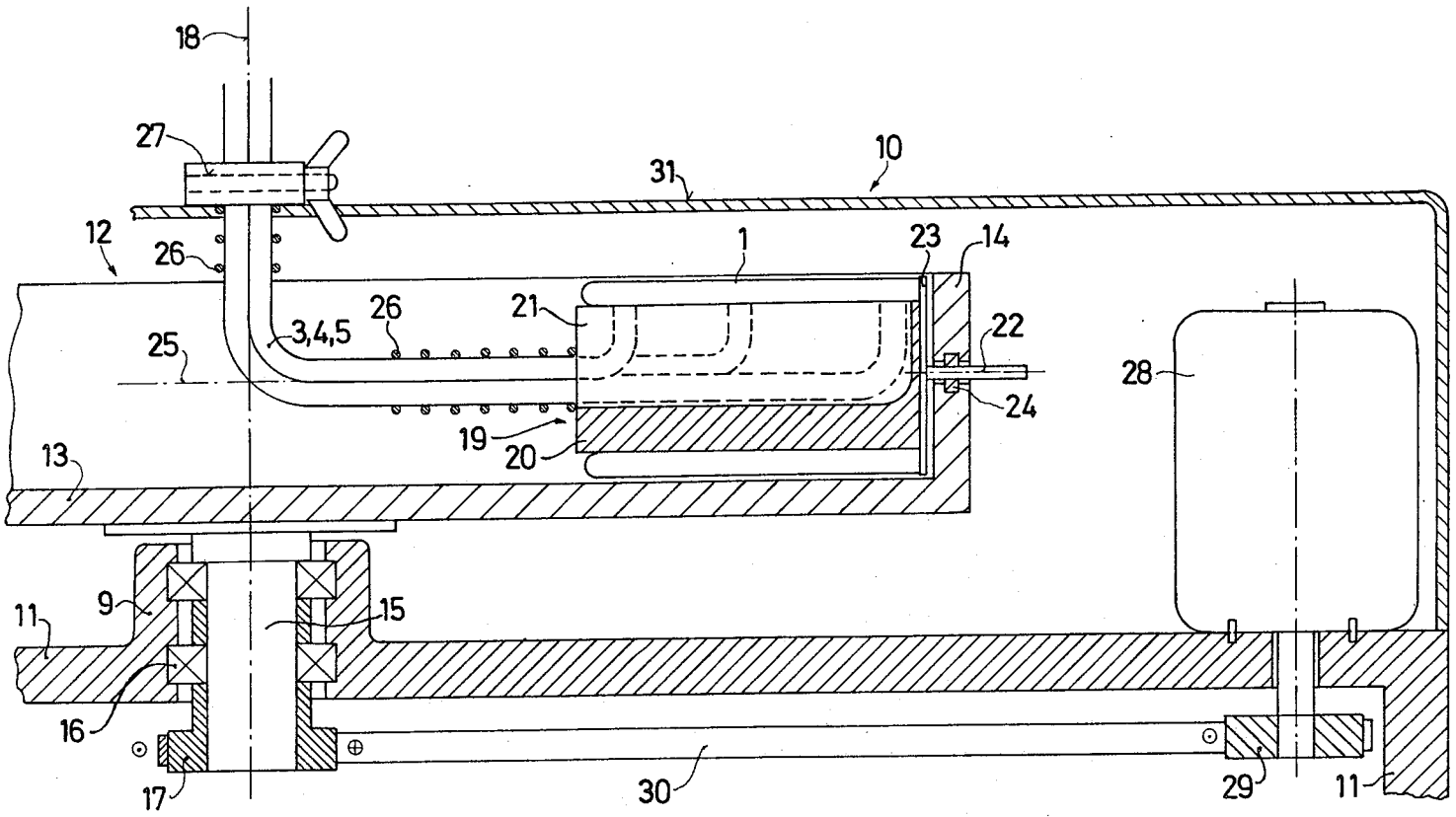
FIG. 5 is a sectional view through an embodiment of a separating centrifuge, including a separating vessel.

FIG. 5 discloses a section of a part of a preferred embodiment of the separating centrifuge. The separating centrifuge is mounted on a frame 11. The separating centrifuge 10 comprises a centrifuge rotor 12, including a circular base plate 13 and an edge 14, which edge 14 projects from one side of the base plate 13. The centrifuge rotor 12 is provided with a stub 15, projecting from the other side at the centre of the base plate 13 and acting as trunnion of the centrifuge rotor. This stub 15 is mounted in bearings 16, arranged in frame 11, and is provided at its free end with a sprocket 17 for a toothed belt.

The centrifuge rotor 12 is rotatable around a vertical axis of rotation 18. Within this centrifuge rotor 12 there is provided a support 19 for the separating vessel 1. This support 19 consists in a cylindrical body 20, in which there is provided a slot 21 intended to receive the connection conduits 3, 4, 5 of the separating vessel 1 and is further provided with a pivot 22, which is mounted to a face surface of the body 20 by means of a plate 23. The support 19 is supported in a ball-bearing 29 mounted within the edge 14 of the centrifuge rotor 12 such that the support 19 is rotatable around a second axis of rotation 25 within the centrifuge rotor 12. This second axis of rotation 25 extends horizontally such that the axis 18 extends perpendicularly to the axis 25, whereby these axis intersect each other. A connecting member 26 is mounted to the other face surface of the cylindrical body 20 co-axially to the second axis of rotation 25. This connecting member 26 is a helix made of steel wire through which steel wire helix the connecting conduits 3, 4, 5 of the separating vessel 1 extend. The other end of this steel wire helix 26 is mounted co-axially to the first axis of rotation 18 on a support 27, which support 27 is mounted to the device such that it will rotate therewith. The connecting conduits 3, 4, 5 are guided through the support 27 to the corresponding known structural parts of the control device, which as mentioned earlier is of a common, well known design and thus is not described in detail herein.

The centrifuge rotor 12 is driven by a motor 28, which motor 28 is mounted to the frame 11 and is provided with a driving shaft, including a sprocket 29 for a toothed belt, serving to rotate the centrifuge rotor 12 by the agency of a toothed belt 30.

There is provided, furthermore, a cover member 31, which is detachably mounted to the frame 11.

Figure 6:
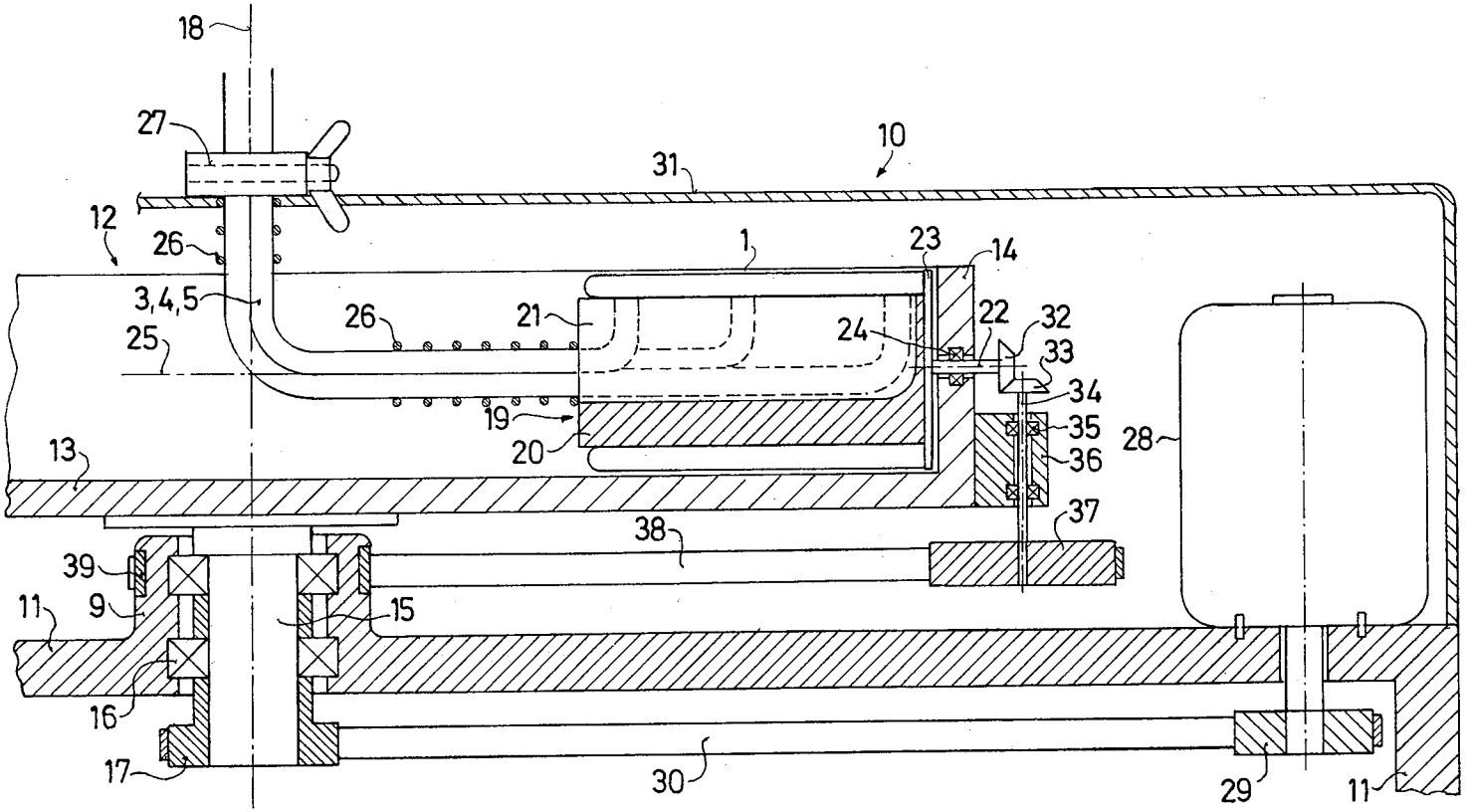
FIG. 6 is a sectional view through a further embodiment of the inventive separating centrifuge and separating vessel.

FIG. 6 discloses a further preferred embodiment of the inventive separating centrifuge. This embodiment as shown in FIG. 6 differs from the embodiment disclosed in FIG. 5 in so far in that the support 12 is provided with a driving means. For this reason the following description is restricted to this driving means only, whereby the same structural elements shown in FIGS. 5 and 6 are provided with the same reference numerals. According to the embodiment as shown in FIG. 6 a bevelled gear-wheel 32 is mounted to the pivot 22. This bevelled gear-wheel 32 meshes with a second bevelled gear-wheel 33, which in turn is mounted to one end of a shaft 34. This shaft 34 is supported in ball-bearings 35, which in turn are mounted within a bearing block 36. This bearing block 36 is mounted to the outer side of the centrifuge rotor 12. A sprocket 37 for a toothed belt is mounted to the other end of shaft 34. The sprocket 37 is connected by the agency of a toothed belt 38 to a second sprocket 39, which is rigidly connected to the frame 11 against rotation about the stub 15 of the centrifuge rotor 12 such that during the rotation of the centrifuge rotor 12 the support 19will rotate in the opposite direction.

In the following the function of the separating centrifuge will be described.

After having inserted the separating vessel 1 into the support 19 and after the connecting conduits 3, 4,5 have been guided through the connecting member 26 and connected to the control device the separating centrifuge can be put into operation. As soon as the control device feeds the liquid to be separated into the separating vessel this control device switches the driving motor 28 on, which driving motor 28 is arranged in the separating centrifuge 10, which driving motor 28 rotates the centrifuge rotor 12 by the agency of the toothed belt 30.

In the preferred embodiment of the separating centrifuge 10, as shown in FIG. 5, the connecting member 26 including its connection conduits 3,4,5 is held against rotation by means of the support 27 at one end such that the above remain always in the same position. If now the centrifuge rotor 12 rotates clockwise a torsion is formed in the connecting member 26 and the connecting conduits 3,4,5. Because the connecting member 26 is a steel wire helix and surrounds tightly the connecting conduits 3,4,5 this arrangement is torsion-proof. Accordingly, this arrangement is given at the support 12 a counter-clockwise rotation such to equalize or neutralize, respectively, this torsion. A separation of the liquid into the fractions proceeds due to the centrifugal process present in the centrifuge rotor according to well known laws.

The support of the preferred embodiment of the separating centrifuge 10 according to FIG. 6 is driven by the agency of the toothed belt 38 and the bevel-gears 32, 33 via the rigidly mounted sprocket for a toothed belt such to equalize the torsion acting onto the connecting member 26 and onto the connecting conduits 3, 4, 5.

While there are shown and described present preferred embodiments of the invention, it is to be distinctly understood that the invention is not limited thereto, but may be otherwise variously embodied and practiced within the scope of the following claims. Accordingly,

What is claimed is:

1. A separating vessel for use in a centrifugal separation of a liquid into fractions of different densities, comprising a double-walled hollow cylindrical body defining an annular chamber and comprising further at least three connection conduits opening into said annular chamber, which annular chamber is partitioned in longitudinal direction thereof such that one of said connection conduits opens into one longitudinal end section and the other of said connection conduits opens into the other, opposite end section of said annular chamber.

2. The separating vessel of claim 1 wherein said hollow cylindrical body consists in a hose welded together at its ends such that said annular chamber is partitioned, and wherein said connection conduits consist of individual hoses welded into said hollow cylindrical body.

3. The separating vessel of claim 1 wherein a plurality of lamella is provided within said annular chamber.

4. The separating vessel of claim 3 wherein said plurality of lamella is manufactured from an extruded medical soft PVC.

5. The separating vessel of claim 1 wherein it is manufactured from an extruded medical soft PVC.

6. A separating centrifuge for the separation of a liquid into fractions of different densities, said centrifuge comprising a separating vessel and control means for controlling the separating process, said separating vessel consisting of a double-walled hollow cylindrical body defining an annular chamber and at least three conduits opening into and integral with said annular chamber, said control means including a centrifuge rotor rotatable about a first vertically extending axis of rotation, supporting means for supporting said separating vessel in said centrifuge rotor and arranged to rotate about a second horizontally extending axis of rotation, and a connection member for receiving connecting conduits of said separating vessel, said connecting conduits being held at one end against rotation and lying generally on said first axis of rotation and being mounted at the other end on said supporting means.

7. The separating centrifuge of claim 6 wherein there is provided a driving means for driving said centrifuge rotor and wherein said connection member is a flexible member intended for rotating said supporting means in order to neutralize the twisting of said connection conduits of said separating vessel due to the rotation of said centrifuge rotor and said separating vessel about said first axis.

8. The separating centrifuge of claim 6 together with first driving means for said centrifuge rotor and second driving means for said supporting means to neutralize the twisting of said connection conduits of said separating vessel due to the rotation of said centrifuge rotor and said separating vessel about said first axis.

9. The separating centrifuge of claim 8 wherein said separating vessel includes a double-walled hollow cylindrical body defining an annular chamber and said three connecting conduits opening into said annular chamber, said annular chamber being partitioned in longitudinal direction thereof such that one of said connecting conduits opens into one longitudinal end section and the other of said connecting conduits opens into the other, opposite end section of said annular chamber.

10. The separating centrifuge of claim 9 wherein said hollow cylindrical body consists of a tubing member welded together at its ends such that said annular chamber is partitioned, and wherein said connecting conduits are in the form of individual hoses welded into said hollow cylindrical body.

* * * * *